United States Patent [19]

White

[11] Patent Number: 4,872,017

[45] Date of Patent: Oct. 3, 1989

[54] SIMPLIFIED MOBILE ANTENNA BASE MOUNTING STRUCTURE

[75] Inventor: Wayne White, Hillside, Ill.

[73] Assignee: Whisco Component Engineering, Inc., Glendale Heights, Ill.

[21] Appl. No.: 300,369

[22] Filed: Jan. 23, 1989

[51] Int. Cl.[4] ..... H01Q 1/12; H01Q 1/32

[52] U.S. Cl. ..... 343/715; 343/888; 343/906

[58] Field of Search ..... 343/715, 713, 900, 906, 343/888; 174/153 A, 152 A, 138 A; 439/551, 559, 916

[56] References Cited

U.S. PATENT DOCUMENTS

| | | | |
|---|---|---|---|
| 4,090,030 | 5/1978 | Lagasse | 343/715 |
| 4,243,989 | 1/1981 | Piper | 343/715 |
| 4,625,213 | 11/1986 | Horn | 343/715 |

*Primary Examiner*—Rolf Hille
*Assistant Examiner*—Michael C. Wimer
*Attorney, Agent, or Firm*—Robert F. Van Epps

[57] ABSTRACT

An insulative housing has a first recess provided with a threaded metal insert adapted to engage a threaded antenna mount on a vehicle. A second relatively smaller recess through which an antenna whip extends has a compression spring which, when the antenna is installed on the vehicle, urges the contact at the lower end of the whip into secure electrical contact with the contact on the mount and also operates to compress a weather seal about the whip at the upper end of the recess.

2 Claims, 1 Drawing Sheet

SIMPLIFIED MOBILE ANTENNA BASE MOUNTING STRUCTURE

BACKGROUND OF THE INVENTION

1. Field of the Invention

The present invention relates generally to mobile communication antennas and more particularly to a simplified and economical antenna base mounting structure.

2. Description of the Prior Art

Prior to the present invention a wide variety of mobile antenna base mounting configurations have been devised. The prior art structures have been complex and involve a multiplicity of parts requiring assembly during the manufacturing process. Representative of such structures are those disclosed in U.S. Pat. Nos. 4,210,914 dated July 1, 1980 to Blackman, 4,186,401 dated Jan. 29, 1980 to Altmayer and 3,624,662 dated Nov. 30, 1971 to Feder.

OBJECTIVES AND SUMMARY OF THE INVENTION

From the foregoing discussion it will be understood that among the various objectives of the present invention are included the following:

- to provide a new and improved mobile antenna base mounting structure;
- to provide an apparatus of the above-described character which is of a simplified and economical construction; and
- to provide an apparatus of the above-described character having a minimum number of parts for assembly.

These and other objectives of the present invention are efficiently achieved by providing an insulative housing with a recessed threaded metal insert for engaging a threaded antenna mount on a vehicle. The antenna whip extends upwardly through a compression spring in a relatively smaller recess in the housing. When assembled with an antenna mount, the spring is compressed and holds a contact at the lower end of whip in secure electrical contract with the contract on the mount. The spring also operates against a washer and weather seal at the upper end of the recess.

The foregoing as well as other objects, features and advantages of the present invention will become better understood from the following detailed description taken in conjunction with the various views of the appended drawings.

DESCRIPTION OF PREFERRED EMBODIMENT

Figure 1:
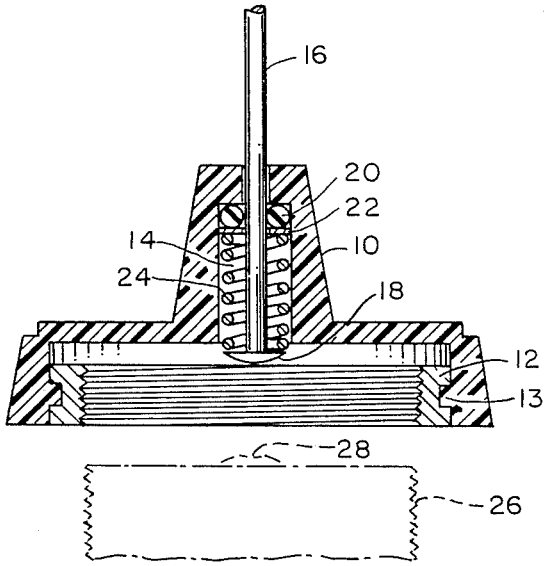
FIG. 1 is a vertical cross-section view of the apparatus of the present invention.

With reference now to FIG. 1 there is shown in vertical cross-section a mobile antenna base mounting structure in accordance with the principles of the present invention. A molded plastic housing 10 has a first cylindrical recess into which an internally threaded metal insert 12 preferably formed of brass, is insert molded or ultrasonically welded. A groove 13 in the outer surface of the insert 12 is provided to control the force required to separate the insert 12 from the housing 10, such that a severe blow will break the antenna base before producing body damage to the vehicle on which it is mounted. A second relatively smaller cylindrical recess 14 extends coaxially upwardly from the first recess. An antenna whip 16 extends through an aperture in the housing 10 and is provided with an electrical contact 18 at its lower end. The diameter of the contract 18 is slightly less than that of the second recess 14. A weather seal in the form of an "O" ring 20 is disposed about the antenna whip 16 at the top of the second recess 14 adjacent an annular washer 22. A compression spring 24 is coaxially disposed about the antenna whip 16.

An antenna mount is shown in phantom at 26 including an electrical contact 28. The antenna mount 26 does not constitute an element of the present invention and is therefore not illustrated in detail. A preferred form of antenna mount is described in U.S. Pat. No. 4,790,774 dated Dec. 13, 1988 for Mobile Antenna Mounting.

Figure 2:
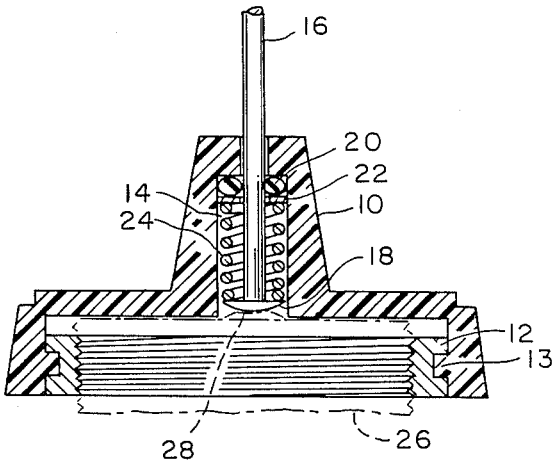
FIG. 2 is a vertical cross-section view of the apparatus of FIG. 1 assembled with an antenna mount.

When the housing 10 with the metal insert 12 is threaded on to the antenna mount 26 as illustrated in the vertical cross-section view of FIG. 2, the electrical contacts 18 and 28 of the antenna whip 16 and mount 26 come into electrical contact and the spring 24 becomes compressed. The spring 24 thus places downward pressure on the antenna whip 16 as well as upward pressure via washer 22 to compress the "O" ring 20 and thereby effect an efficient weather seal.

From the foregoing it will be understood that the applicant has provided a new and novel mobile antenna base mounting structure whereby the objectives set forth hereinabove are efficiently met. Since certain changes in the above-described construction will occur to those skilled in the art without departure from the scope of the invention it is intended that all matter set forth herein or shown in the various views of the appended drawings shall be interpreted as illustrative and not in a limiting sense.

Having described what is new and novel and desired to secure by Letters Patent, What is claimed is:

1. A mobile antenna base mounting structure comprising

- an electrically insulative housing having a first cylindrical recess in the lower surface thereof, a second cylindrical recess relatively small than said first recess extending coaxially upwardly from said first recess, and an aperture extending from said second recess coaxially upwardly through the upper surface of said housing;
- an internally threaded metallic insert secured in said first recess and adapted to engage an antenna mount;
- an annular groove disposed in the outer surface of said metallic insert, engaging the inner surface of said first recess in said housing, and having a width and depth selected to limit the force required to separate said metallic insert from said housing to a predetermined level;
- an antenna whip having an electrical contact at the lower end thereof and extending upwardly through said second recess and aperture to the exterior of said housing; and
- a compression spring disposed coaxially about the antenna whip in said second recess such that when said metallic insert is threaded onto an antenna mount said spring is compressed, bears upon the electrical contact on said antenna whip, and exerts downward pressure thereon.

2. A mobile antenna base mounting structure as described in claim 1 further including an o-ring weather seal disposed about said antenna whip adjacent the upper end of said second recess; and an annular washer disposed about said antenna whip between said o-ring and said compression spring such that when said metallic insert is threaded onto an antenna mount said spring also bears upon said washer and o-ring to thereby effect a weather seal about said antenna whip.

* * * * *